US005918315A

United States Patent [19]

Trachtenberg

[11] Patent Number: 5,918,315

[45] Date of Patent: Jul. 6, 1999

[54] UTILITARIAN FASHION SLEEVE

[76] Inventor: Steven Trachtenberg, 245 Verdan Dr. N., York, Pa. 17403

[21] Appl. No.: 08/801,061

[22] Filed: Feb. 14, 1997

[51] Int. Cl.[6] ..... A41B 1/08

[52] U.S. Cl. ..... 2/125; 2/115; 2/126

[58] Field of Search ..... 2/1, 46, 59, 16, 2/125, 126, 115, 108

[56] References Cited

U.S. PATENT DOCUMENTS

| | | | |
|---|---|---|---|
| 1,141,656 | 6/1915 | Rosenbaum et al. | 2/59 |
| 1,296,430 | 3/1919 | Riley | 2/59 |
| 4,843,645 | 7/1989 | White | 2/59 |
| 4,951,317 | 8/1990 | Gray et al. | 2/59 |
| 5,048,126 | 9/1991 | McLauglin | 2/125 |
| 5,628,062 | 5/1997 | Tseng | 2/59 |

*Primary Examiner*—Gloria M. Hale

*Attorney, Agent, or Firm*—Caesar, Rivise, Berstein, Cohen & Pokotilow, Ltd.

[57] ABSTRACT

A fashion sleeve to be worn by a person, the fashion sleeve comprising a hollow tubular cloth or woven member having a wider upper opening and a narrower wrist opening, with the sleeve being tapered from the upper arm opening to the wrist opening and the upper opening having means to engage snugly the arm of the person.

3 Claims, 1 Drawing Sheet

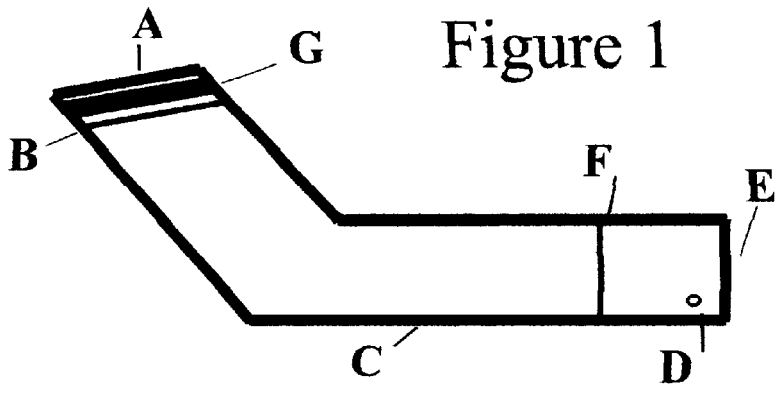
Figure 1
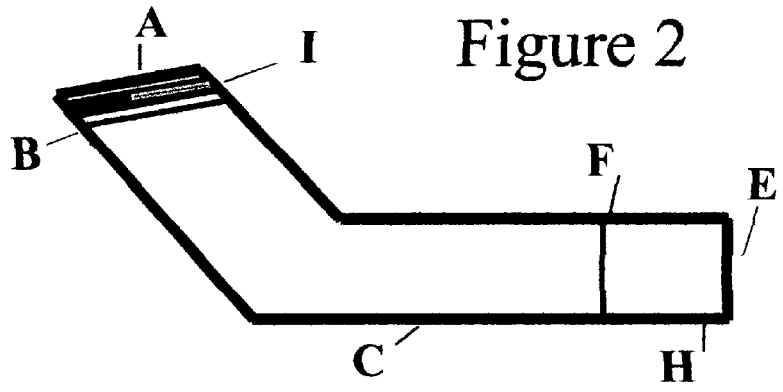
Figure 2
Figure 3
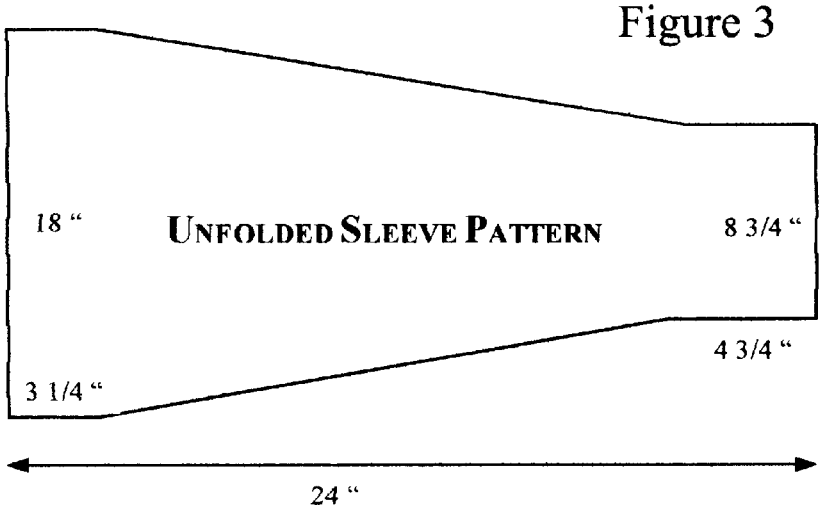
Figure 4
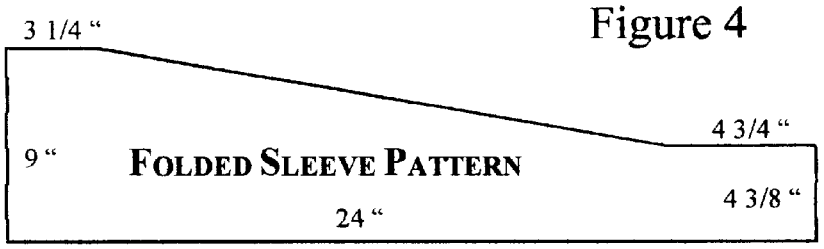

UTILITARIAN FASHION SLEEVE

BACKGROUND OF INVENTION

Most conventional clothing is designed to cover an entire portion of the body usually either the upper body (with a shirt, etc.) or the lower body (with pants, etc.). Much of the clothing made for the upper body is designed to cover the wearer's midsection, torso, shoulders, and arms. Such apparel covers the upper body as well as the other clothing that is worn underneath and in conjunction with the apparel. The T-shirt is the basic upper body covering. When greater warmth or protection is needed or required, other apparel can be added to this layer or replace it entirely (sweatshirt, jacket, etc.).

There are many disadvantages of current upper body apparel. The first disadvantage is that the this apparel covers up the T-shirt or undershirt. Many T-shirts have designs or logos on them which the wearer wants to display, hence the reason for their purchase. When these are covered up, they are no longer seen by the wearer or others. Individuals would like to wear their T-shirts even when impractical (such as in colder weather, while hiking, etc.). The second disadvantage is the bulkiness of the extra clothing. Certain situations require added warmth or protection, but might not warrant a jacket or other heavy clothing. A third disadvantage is the inconvenience of carrying these garments. Jackets and sweatshirts have to be either carried or tied around one's waist. The possibility of laying extra clothing down could result in the theft or forgetting of it. A fourth disadvantage is that much of the clothing must be pulled over the wearer's head, both to put it on and to take it off. This usually results in "messing up" the hair of the individual. The last disadvantage of this apparel is the expense. It is necessary to buy extra clothing, only to cover up other clothing.

SUMMARY OF INVENTION

In my invention, I have designed an accessory piece of apparel consisting of a pair of sleeves. The sleeve covers the wearer's arms from the wrist to the upper bicep (like those found on a long sleeve shirt or sweatshirt).

This invention differs from other examples of sleeve inventions such as in U.S. Pat. No. 3,657,741 or U.S. Pat. No. 4,951,317 because the sleeve is designed and intended for everyday use.

The invention is designed to be used in conjunction with short sleeved shirts. When the sleeves are worn, the short sleeve of the T-shirt covers the uppermost portion of the sleeves. Therefore, only the wearer knows the sleeves are additional pieces of apparel. The benefits of the sleeves are as follows:

The invention offers the wearer style. The sleeves are designed to be a fashion accessory. They may come in a variety of colors, patterns, fabrics, and styles. Sleeves enable the wearer to mix and match different sleeves with their wardrobe. The invention also allows the short sleeved shirt to be seen. Additionally, they do not add bulk to one's outfit.

The invention provides the wearer added warmth, specifically to the upper extremities. The invention can be worn in conjunction with short sleeved shirts in cooler weather year-round. Additional warmth can be obtained by wearing sleeves composed of heavier materials. If the temperature permits, sleeves can be easily removed from the wearer, leaving behind the T-shirt.

The invention provides the wearer added protection, specifically to the arms. The sleeves offer the wearer protection from external elements such as rain, wind, etc. They can protect the wearer's arms from briars while hiking, the pavement while skateboarding, or paint while painting. Fluorescent colored sleeves can also be used for cyclists or runners for nighttime safety.

The invention also offers convenience to the wearer. The sleeves simply pull on and off in seconds. There is no need to "mess up" one's hair because the apparel does not go over the head. When the sleeves are not needed, they can be easily hung from a belt or carried in a pocket.

DESCRIPTION OF THE DRAWING

FIG. 1 shows side view of right sleeve with nonadjustable elastic upper opening and button cuff wrist opening.

FIG. 2 shows side view of right sleeve with adjustable upper opening and cuffed wrist opening.

FIG. 3 shows the cut-out pattern of a sleeve.

FIG. 4 shows the folded cut-out pattern of a sleeve. (The pattern is the same as in FIG. 4)

Referring to FIG. 1 and FIG. 2, the sleeve has an upper arm opening, A, and a wrist opening, E. The sleeve is formed from a single piece of fabric by sewing together the longitudinal edges, C, hence, forming a tubular garment. The sleeve is tapered from the upper arm opening, A, to the wrist opening, E, resulting in a larger circumference at the upper opening, A, and a smaller circumference at the wrist opening, E. This is designed to accommodate the varying circumference of an individual's arm.

The upper opening, A, of the sleeve has a means for engaging the upper arm of the wearer. The uppermost portion of the sleeve, B, is meant to fit snugly around the wearer's bicep, however, it is designed as to not impede blood flow to the arm. It is also designed to be worn during everyday use without discomfort or restriction of movement. This can be achieved in a multitude of ways. FIG. 1 shows the generic cuff, B, at the upper end of the sleeve in which a piece of elastic is sewn or inserted into. FIG. 2 shows the upper end of the sleeve with a piece of Velcro, I, sewn onto the cuff, B, which contains the elastic. This allows the wearer to manually vary the size of the upper opening to the desired comfort level. There are other mechanisms available to allow the wearer to adjust the size of the opening including but not limiting to drawstrings, buttons, hook and pile, etc.

The wrist opening, E, of the sleeve is of a smaller circumference then that of the upper opening. It is also not meant to engage the wearer like the upper opening. The sleeve is designed in such a way that it is easily removable. Because the sleeve is designed for comfortable everyday use, there are a multitude of possible wrist openings. FIG. 1 shows a cuff, D, (similar to those found on dress shirts) which would be fastened to the tubular garment, F. The cuff, D, can be buttoned or unbuttoned whichever the wearer desires. FIG. 2 shows a ribbed, stretchy wrist opening, H. Other possible wrist openings include but are not limited to snap, zipper, drawstring, Velcro, etc.

The sleeve may be made in several different sizes such as small, medium, and large. Sizes may vary both the upper arm opening, A, and the wrist opening, E. Sizes may also vary the length of the sleeve, C. Different sizes are necessary due to differing arm lengths and circumferences of individuals of different age groups and sexes. FIG. 3 and FIG. 4 show an example of a "large-sized" sleeve pattern for a male wearer. These figures are designed for a sleeve similar to the one pictured in FIG. 2.

The sleeve can be made with any number of different materials including cotton, wool, polyester, etc. However, the sleeve is designed to be made with a material comfortable for everyday use.

I claim:

1. A method of wearing a fashion sleeve in combination with a shirt having short sleeves, the method comprising providing said shirt with short sleeves and also providing said fashion sleeve, said fashion sleeve comprising a hollow tubular cloth or woven member having an upper arm opening and a narrower wrist opening, the sleeve being tapered from said upper arm opening to said wrist opening, the upper arm opening having means to engage snugly the arm of a person, said method comprising the further step of a person inserting his or her arm in the upper arm opening and the wrist opening so that the fashion sleeve engages a portion of the arm of the person tightly, the shirt short sleeve engaging an uppermost portion of the arm such that the shirt short sleeve overlaps upon and covers an uppermost portion of the fashion sleeve while the fashion sleeve engages the remainder of the arm.

2. The method of claim 1 wherein said fashion sleeve is continuous.

3. In combination, a fashion sleeve and a shirt having at least one short sleeve, said fashion sleeve being of the same material as the shirt short sleeve, said fashion sleeve being worn directly on an arm of a person in contact with said arm, said fashion sleeve comprising a hollow tubular cloth member having an upper arm opening and a narrower wrist opening, said fashion sleeve being tapered from an upper arm opening to a wrist opening, the upper arm opening having means to snugly engage the arm of the person, the fashion sleeve being continuous, said shirt short sleeve engaging an uppermost portion of the arm, said shirt short sleeve overlapping upon an uppermost portion of said fashion sleeve and said fashion sleeve engaging and covering the remainder of the arm.

* * * * *